United States Patent [19]

Gnuechtel et al.

[11] Patent Number: 5,075,128

[45] Date of Patent: Dec. 24, 1991

[54] SILICONE APPLICATOR WITH OVERFLOW CONTROL

[75] Inventors: Herman C. Gnuechtel, Arlington Heights; Brian D. Urfer, Western Springs; Trevor S. Baird, Woodstock; Mark Lake, Sparta, all of Ill.

[73] Assignee: Web Printing Controls Co., Inc., Barrington, Ill.

[21] Appl. No.: 392,691

[22] Filed: Aug. 11, 1989

[51] Int. Cl.[5] ..... B05D 1/28

[52] U.S. Cl. ..... 427/8; 427/424; 118/683; 118/684; 118/258

[58] Field of Search ..... 427/424, 8; 118/683, 118/684, 693, 694, 258, 259, 244, 223; 137/558, 590.5

[56] References Cited

U.S. PATENT DOCUMENTS

| | | | |
|---|---|---|---|
| 3,511,693 | 5/1970 | Davidson | 118/259 X |
| 4,015,559 | 4/1977 | Sears et al. | 118/259 |
| 4,020,488 | 4/1977 | Martin et al. | 137/558 X |
| 4,239,956 | 12/1980 | Morton | 137/590.5 X |
| 4,251,566 | 2/1981 | Gingerich | 118/684 X |
| 4,311,114 | 1/1982 | Lees et al. | 118/694 |
| 4,347,269 | 8/1982 | Keep | 427/428 |
| 4,376,670 | 3/1983 | Rodish | 156/244.21 |
| 4,444,147 | 4/1984 | Dahlgren et al. | 118/261 |
| 4,533,563 | 8/1985 | Dahlgren et al. | 427/337 |
| 4,637,341 | 1/1987 | Switall | 118/694 |
| 4,641,404 | 2/1987 | Seydel et al. | 118/259 X |
| 4,643,124 | 2/1987 | Switall | 118/259 |
| 4,700,734 | 10/1987 | McCauley et al. | 137/590.5 X |
| 4,704,296 | 11/1987 | Leanna et al. | 427/9 |

*Primary Examiner*—Shrive Beck
*Assistant Examiner*—Alain Bashore
*Attorney, Agent, or Firm*—Welsh & Katz, Ltd.

[57] ABSTRACT

Silicone application apparatus and method for applying a controlled amount of silicone emulsion to the surface of a moving web such as a continuous web in a printing press. The applicator comprises a silicone supply tank, a silicone emulsion applicator tray, a pump for pumping silicone emulsion from the supply tank to the applicator tray, and applicator rollers in contact with the silicone emulsion in the tray and the moving web to apply the silicone emulsion to the moving web. The application tray includes an operating level drain to maintain an operating level of silicone emulsion in the tray, a overflow drain at a higher level which prevents overflow of the application tray in the event that the operating level drain is clogged. An electronic monitoring device is provided for monitoring the silicone applicator level and generating a level fault signal when the level of silicone emulsion exceeds a predetermined level and for turning off the pump and disengaging the applicator rollers in response to the overflow signal.

16 Claims, 3 Drawing Sheets

SILICONE APPLICATOR WITH OVERFLOW CONTROL

The present invention relates generally to an improved apparatus and method for operating on a web material, and more particularly to an improved web handling apparatus and method for applying an aqueous silicone emulsion to the surface of a web such as a continuous web in a printing press or the like.

Silicone applicators are known in the prior art for applying a silicone coating to the surface of a web, for example, on newspaper, business forms, and in other commercial web operations in order to lubricate the surface of the web for ease of handling and separation of the sheets. The web substrate may comprises any web material such as paper, foil, kraft, plastic films, etc. Typically, a silicone concentrate is mixed with water in a main tank and then pumped to an application tray from which it is picked up by rollers and applied to the web. In the prior art silicone applicators, the silicone emulsion often overflowed and application tray and dripped onto other parts of associated web handling machinery. This overflow is often caused by clogging of the drain due to the nature of the silicone emulsion and the harsh environment. Unfortunately, silicone emulsions can be highly corrosive to the materials used on web handling machinery. As a result, the application trays have to be closely monitored by the operator to protect the web handling machinery from costly damage. Even so, monitoring often fails to prevent serious and costly damage when clogging and the resultant overflow is not detected soon enough.

Accordingly, it is a primary object of the present invention to provide an improved silicone applicator system which automatically monitors the silicone emulsion level and minimizes the risk of application tray overflow.

It is another object of the present invention to provide a silicone applicator which automatically regulates the coating of the silicone emulsion and which comprises a multiple overflow protection system which monitor silicone emulsion levels, informs the operator of level fault, and automatically controls silicone emulsion level.

It is another object of the present invention to provide a silicone applicator which comprises automatic monitoring and control of the silicone emulsion level and backup overflow protection.

Briefly, according to one embodiment of the invention, silicone application apparatus is provided for applying controlled amounts of silicone emulsion to at least one surface of a moving web in web handling machinery. The apparatus comprises a silicone emulsion tank, a silicone application tray for holding a supply of silicone emulsion for application to the web surface and a pump for pumping silicone emulsion from the supply tank to the application tray. Application rollers are also provided, positionable to contact the emulsion in the application tray and to contact the surface of the web to pick up the emulsion from the application tray and apply it to the surface of the web. The application further comprises an application level drain outlet which drains any excess silicone emulsion to maintain an operating silicone emulsion level in the tray thereby providing a desired rate of emulsion transfer to the roller and to the web surface. A backup overflow drain is provided which drains any excess silicone emulsion which exceeds a predetermined second overflow level of emulsion in the application tray, such level being greater than a first overflow level. An electronic monitoring device is mounted on the application tray for monitoring the silicone application level and generating a level fault signal in response to the silicone emulsion level in the application tray exceeding the first overflow level which is a predetermined amount above the operating silicone emulsion level.

BRIEF DESCRIPTION OF THE DRAWINGS

The invention, together with further objects and advantages thereof, may be understood by reference to the following description taken in conjunction with the accompanying drawings.

DETAILED DESCRIPTION OF THE PREFERRED EMBODIMENT

Figure 1:
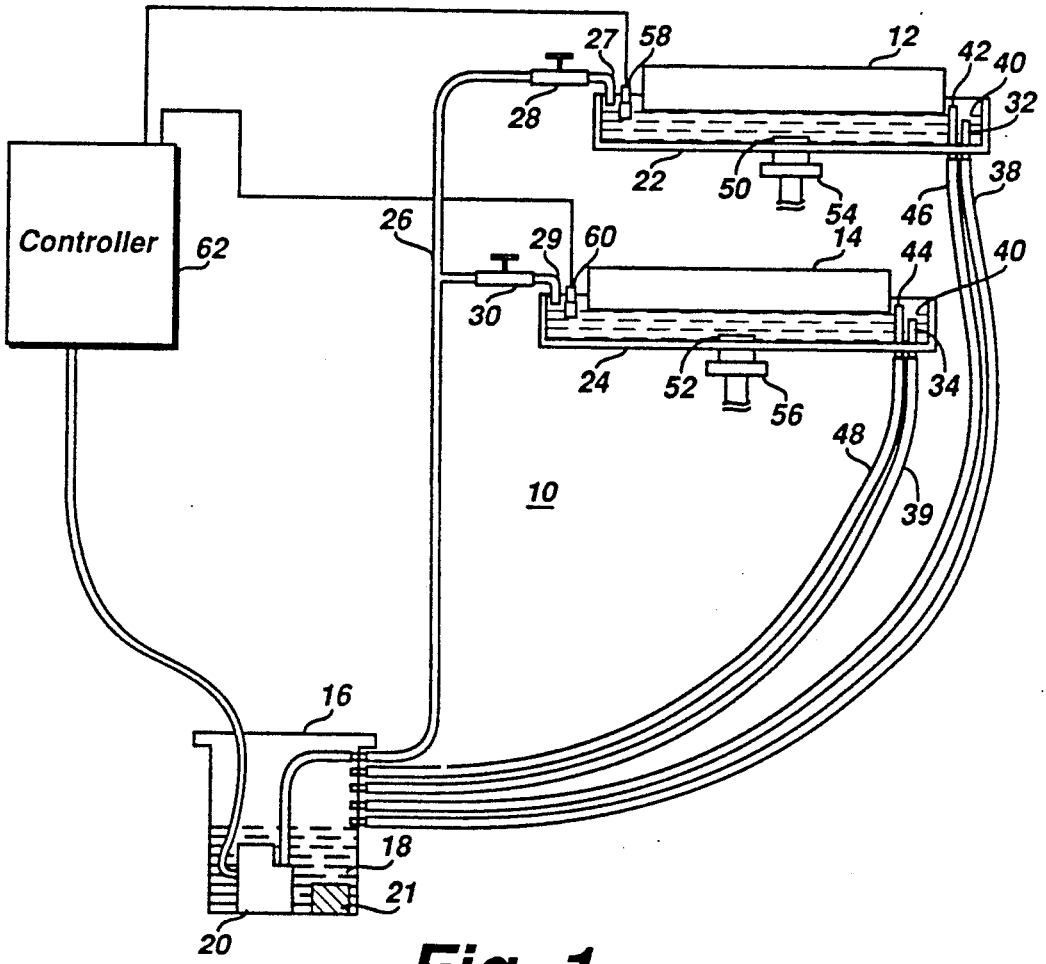
FIG. 1 is a generalized diagrammatic front view of a specific embodiment of a silicone applicator system according to the invention.

FIG. 1 is a generalized diagrammatic front view illustrating a specific embodiment of an application silicone applicator system 10 according to the invention for use in conjunction with web handling apparatus to apply an aqueous silicone emulsion to a web (not shown) by means of applicator rollers such as rollers 12, 14. In the illustrated embodiment, an upper applicator roller 12 may, for example, apply the aqueous silicone emulsion to one side of the web while a lower applicator roller 14 may apply it to the opposite side of the web. Alternatively, only one roller may be used to apply the silicone emulsion to only one surface of the web.

A supply tank 16 is provided to serve as a reservoir of silicone emulsion 18 which is typically made up of conventional silicone concentrate and water mixed together as a batch in the tank 16. A pump 20 (e.g., a model 3E-12N marketed by Little Giant Co.), which in the illustrated embodiment is emersed in the silicone emulsion 18 within the tank 16, is used to pump the silicone emulsion from the supply tank 16 to an upper applicator tray 22 and a lower applicator tray 24 via a fluid line 26, as shown. The fluid line 26 includes flow regulators 28 and 30 (e.g., a model N-25B marketed by Deltrol Fluid Products) which are adjustable regulators to permit regulated flow of silicone emulsion into the applicator trays 22, 24 through respective inlets 27, 29 while also permitting operator adjustment of the flow rate. An agitator 21 may optionally be placed in the supply tank 16 to keep the silicone emulsion properly mixed. For example, a second pump identical to the pump 20 can be submerged in the tank 16 to constantly circulate the silicone emulsion.

The regulated flow of silicone emulsion through the flow regulators 28, 30 continuously maintains a supply of silicone emulsion to the applicator trays 22, 24. An operation level of silicone emulsion 40 is maintained in each tray by an operation level drain 32, 34. The operation level drain 32, 34 drains off any emulsion which raises above the drain level and returns it to the system tank 20 via fluid lines 38, 39, as shown. The operation level is an appropriate level selected so that the applicator rollers 12, 14 may be in contact with the emulsion 40, as shown.

Overflow drains 42, 44 are respectively provided in each applicator tray 22, 24 to drain off silicone emulsion and return it to the supply tank 16 via a fluid line 46, 48, respectively, if the level raises to the overflow drain level. These fluid lines 46, 48 may alternatively run into an external drain (not shown) rather than return to the supply tank 16. This may occur, for example, if the application level drain 32, 34 becomes clogged. Thus, the overflow drains 42, 44 prevent silicone emulsion from overflowing the trays 22, 24 in the event all other systems to control the silicone emulsion level fail. In addition, zero level drains 50, 52 are respectively provided in the bottom of the applicator trays 22, 24 to permit complete draining of the trays by opening the respective valve 54, 56 or removal of a cover (not shown) which may be fitted on the drains 50, 52 to close them off. The zero level drains 50, 54 permit the silicone emulsion in the tray to be drained from the applicator trays 22, 24 to the supply tank 16 via appropriate fluid lines (not shown).

Each applicator tray 22, 24 also includes a respective level sensitive switch 58, 60 which are coupled electrically to a controller circuit 62, as shown. Each level sensitive switch 58, 60 (e.g.., conventional float switches in the illustrated embodiment) detects a level of the silicone emulsion slightly above the operation level and generates a level fault signal in response thereto. The level fault signal is processed by the controller circuit 62 which activates a level fault indicator light, or alternatively an alarm, to alert the operator that the silicone emulsion level has exceeded the operation level thus indicating that an operation level drain 32, 34 may be clogged. The controller circuit 62, in the illustrated embodiment, also turns off the pump 20 to stop flow of silicone emulsion to the trays 22, 24 to prevent overflow, removes the rollers 12, 14 from contact with the web, and stops the rotation of the rollers 12, 14.

Figure 2:
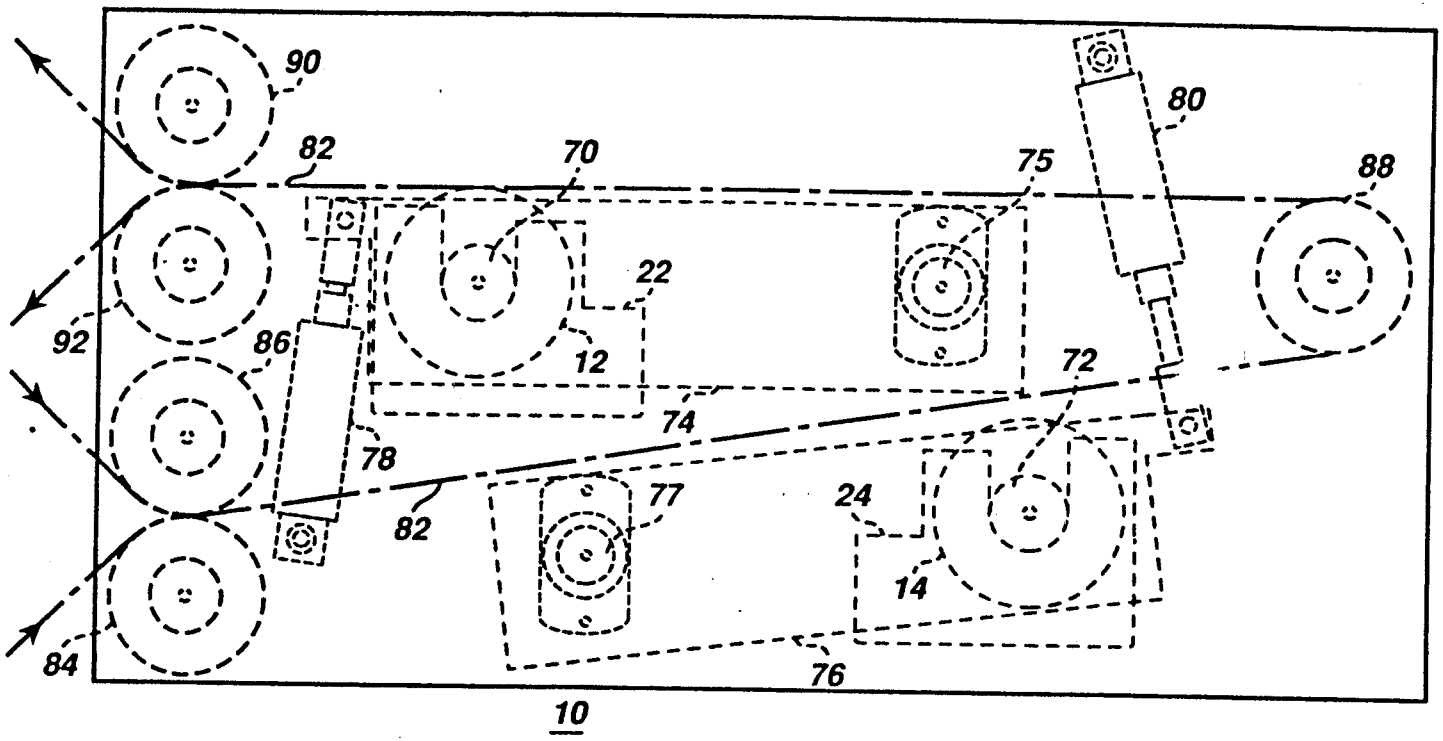
FIG. 2 is a side view illustrating a specific embodiment of a silicone applicator according to the invention.

Referring now to FIG. 2, there is shown a side view of a specific embodiment of the silicone applicator 10 illustrating the major mechanical elements of the apparatus 10. The applicator trays 22, 24 are located with applicator rollers 12 and 14 configured to be rotatable on respective shafts 70, 72, as shown. The shafts 70, 72 are mounted respectively on tiltable brackets 74, 76 which can be tilted about shafts 75, 77, respectively, by attached air cylinders 78, 80. In the illustrated embodiment, a web 82 may run between inlet rollers 84, 86 around an idler roller 88 and out between exit rollers 90, 92 such that the web passes over the applicator rollers 12, 14, as shown.

Consequently, the applicator rollers 12, 14 may be moved upward by the action of the cylinders 78, 80 to bring them in contact with the web 82, or the rollers 12, 14 may be moved down to disengage them from the web 82. While the web is in contact with the rollers 12, 14 and in contact with the silicone emulsion in the applicator trays 22, 24, they are rotated, by means of an electric motor (not shown) in the illustrated embodiment, to thereby transfer silicone emulsion to the surface of the web 82. In this manner, the upper tray 22 and roller 12 can apply silicone emulsion to one side of the web 82, and the lower tray 24 and roller 14 can apply silicone emulsion to the other side of the web 82.

Figure 3:
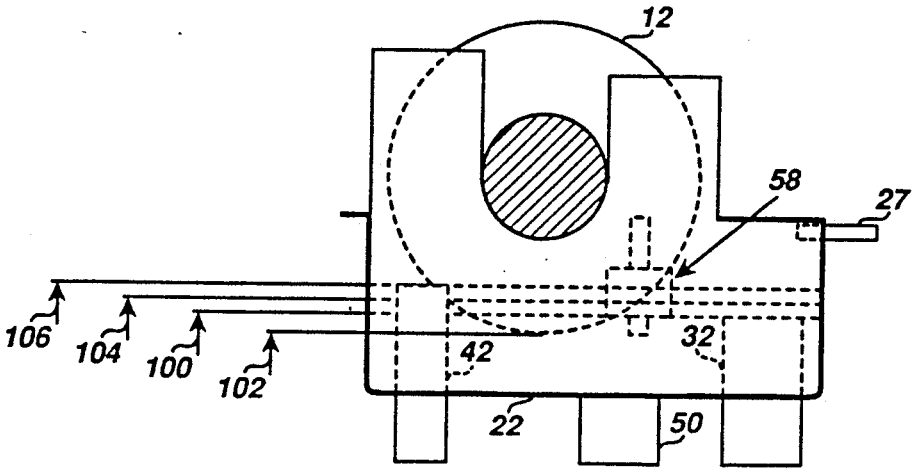
FIG. 3 is a side view illustrating the specific embodiment of a application roller and application tray according to the invention.

While each of the application trays 22, 24 in the illustrated embodiment are essentially identical, FIG. 3 is a detailed side view illustrating a specific embodiment of the upper applicator tray 22 and applicator roller 12 of FIG. 2. The applicator roller 12 is mounted within the applicator tray 22, as shown, such that it can rotate in contact with the silicone emulsion in the tray 12 and pick up silicone emulsion thereby transferring it to the web. Controlled amounts of silicone emulsion are transferred by maintaining a predetermined operating level 100 of silicone emulsion and a controlled rate of rotation of the applicator roller 12. The supply of silicone emulsion is maintained in the tray above a minimum operating level 102 by pumping silicone emulsion from the supply tank 16 into the tray through the emulsion inlet 27.

The operation level drain 32 operates to maintain the predetermined operating level 100, as shown, by draining off any excess emulsion which overflows into the drain, and by returning the excess to the supply tank 16. If this drain becomes clogged, as can occur due to the nature of the emulsion and the accumulation of debris in the emulsion, the float switch 58 will be activated when the emulsion level rises up the float switch trigger level 104. The switch 58 may be any level sensitive switch for detecting the rise of the emulsion level to the trigger level 104. The float switch 58 generates a level fault signal which triggers the control of circuitry 62 (see FIG. 1) to activate a level fault indicator light in the illustrated embodiment, and may also trigger an audible alarm or other operator fault indicator. In addition, in the illustrated embodiment, the control of circuit 62 turns off the silicone emulsion pump 20 in response to the level fault signal to prevent overflow of the tray 22. The controller 62 also activates the air cylinder 78, 80 to disengage the rollers from the web and stops the rotation of the applicator rollers 12, 14 in response to the level fault signal.

If one of the float switches 58, 60 becomes jammed or otherwise fails to operate when the emulsion level rises, the back-up overflow drain 42 drains off excess silicone emulsion above the overflow level 106, which is above the float switch trigger level 104, but below the top edge of the tray 22, as shown. The excess silicone emulsion drained through the overflow drain 42 is returned to the supply tank 16. This additional overflow drain provides extra overflow protection to prevent the costly damage caused by the overflow of a silicone emulsion. The zero level drain 50 located in the bottom of the tray 22 permits complete draining of the tray for cleaning, etc.

Figure 4:
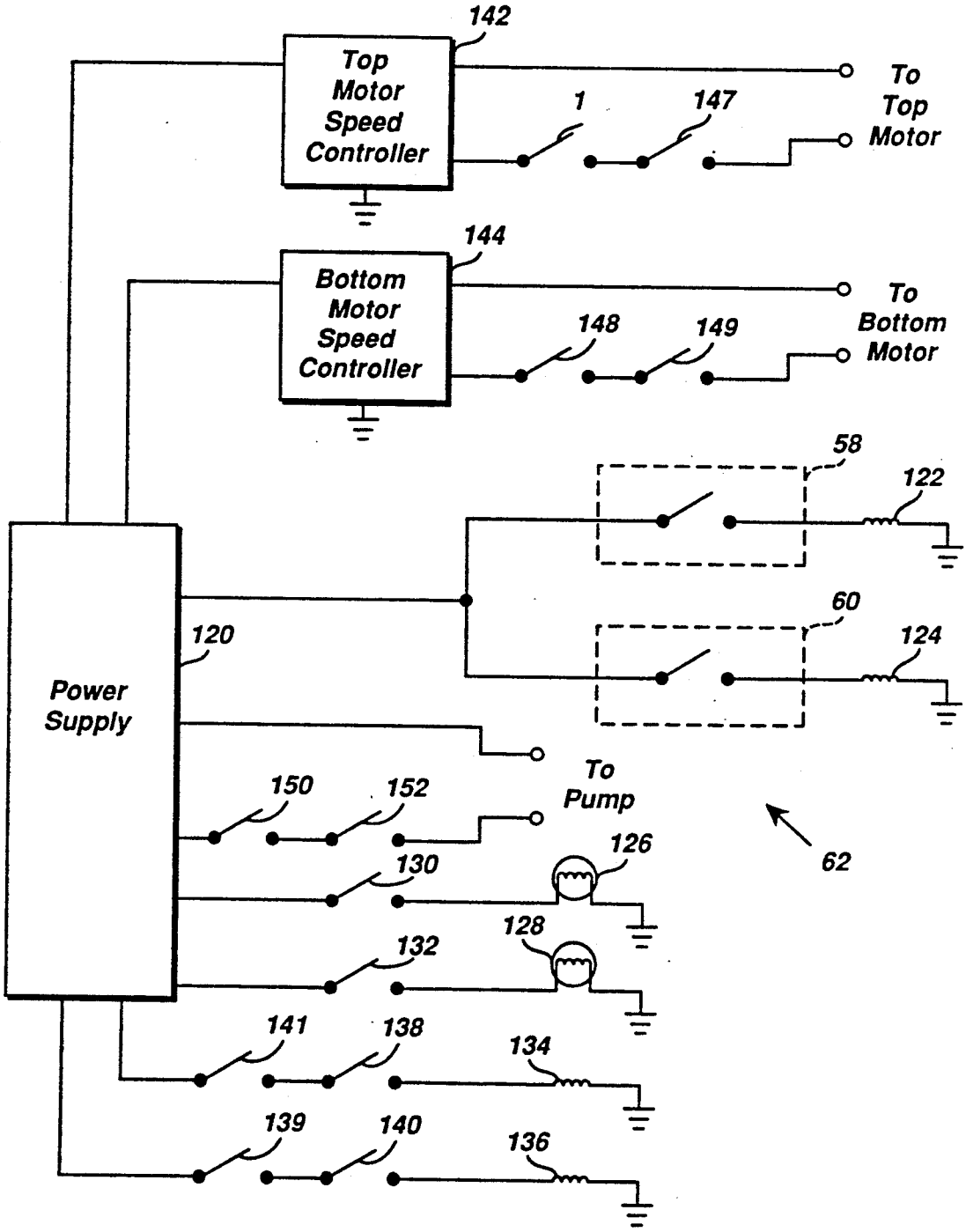
FIG. 4 is a detailed block diagram of a specific embodiment of controller circuitry for monitoring the silicone emulsion level and automatically controlling the level and the application of silicone emulsion in accordance with the invention.

Referring now to FIG. 4, there is shown a detailed block diagram of a specific embodiment of a controller circuit 62. The illustrated embodiment of the controller circuit 62 includes a power supply 120 which provides power for all the electrical elements of the controller 62. The top float switch 58 and the bottom float switch 62 are each respectively connected in series with the power supply 120 and a respective top relay coil 122 and bottom relay coil 124, as shown. Thus, when the silicone emulsion level reaches the trigger level (i.e., generates a level fault), the associated float switch 58, 60 closes applying power to activate the respective relay coil 122, 124. When activated, the top relay coil 122 will close or open associated top relay switches and the bottom relay coil 124 will close or open associated bottom relay switches as described hereinafter. The relay switches return to normal when the relay coils 122, 124 are deactivated.

A top fault light 126 and a bottom fault light 128 are coupled respectively in series with a top relay switch 130 and a bottom relay switch 132, each in series with the power supply 120, as shown. Thus, when a relay coil 122, 124 is activated, the associated relay switch 130, 132 is closed turning on the associated fault light 126, 128 to indicate a level fault. Similarly, a top applicator roller engagement valve solenoid 134 is coupled to the power supply 120 in series with a top relay switch 138 and a bottom relay switch 141 and a bottom applicator roller engagement valve solenoid 136 is respectively coupled in series with a top relay switch 139 and a bottom relay switch 140, in series with the power supply 120, as shown. The roller solenoids 134, 136 activate the air cylinders 78, 80 to move the application rollers out of engagement with the web in the event of a level fault. Thus, when a relay coil 122, 124 is activated, the associated relay switches 138, 139, 140, 141 are closed energizing both solenoids 134, 136 which disengages both applicator rollers 12, 14 from the web.

A top motor speed controller 142 and a bottom motor speed controller 144 are coupled to the power supply 120 to provide power for the controllers 142, 144. The motor speed controllers 142, 144 provide power to the applicator roller motors so as to maintain the desired speed of roller rotation. In series with the top roller motor circuit are both a top relay switch 146 and a bottom relay switch 147 and in series with the bottom roller motor circuit is a bottom relay switch 148 and a top relay switch 149, each of which is a normally closed switch which is opened by the activation of the associated relay coil 122, 124. Thus, when a relay coil 122, 124 is activated, the corresponding relay switches 146, 147, 148, 149 are opened removing power from the roller motors, thereby stopping rotation of the rollers 12, 14.

The power circuit for the silicone emulsion pump 20 includes a top relay switch 150 and a bottom relay switch 152 in series which are normally closed switches. Thus, when a relay coil 122, 124 is activated by a level fault, the corresponding relay switch 150, 152 is opened cutting off the power to the pump 20, thereby stopping the pump. After the float switches 58, 60 reopen, the relay coils 122, 124 deactivate, the relay switches return to their normal condition, and the applicator system 10 can return to normal function.

Specific embodiments of the novel silicone application apparatus and method have been described for the purpose of illustrating the manner in which the invention may be made and used. It should be understood that implementations of other variations and modification of the invention in its various aspects will be apparent to those skilled in the art and that the invention is not limited thereto by the specific embodiments described. It is therefore contemplated to cover by the present invention any and all modifications, variations, or equivalents that fall within the true spirit and scope of the underlying principles disclosed and claimed herein.

What is claimed is:

1. Silicone application apparatus for applying controlled amounts of silicone emulsion to at least one surface of a moving web in web handling machinery, comprising:

a silicone emulsion supply tank which serves as a reservoir of silicone emulsion;

a silicone emulsion applicator tray for holding a supply of silicone emulsion for application to the web surface;

a pump for pumping silicone emulsion from the supply tank to the applicator tray;

applicator rollers positionable to contact the emulsion in the applicator tray and to contact the surface of the web and adapted to rotate so as to pick up the silicone emulsion from the applicator tray and apply it to the surface of the web;

said silicone emulsion applicator tray comprising an operation level drain outlet which drains any excess silicone emulsion to maintain a predetermined operating silicone emulsion level in the tray;

a monitoring device mounted on the applicator tray for monitoring the silicone emulsion level and generating a level fault signal in response to the silicone emulsion in the applicator tray exceeding a first overflow level which is predetermined amount above the operating silicone emulsion level; and means for moving the applicator rollers out of contact with the silicone emulsion in response to the level fault signal,

2. The apparatus of claim 1 wherein the operation level drain outlet comprises a drainline with an opening located a predetermined level above the bottom of the applicator tray which returns the excess silicone emulsion to the silicone emulsion supply tank.

3. The apparatus of claim 2 wherein the backup overflow drain comprises a drain line which returns the excess silicone emulsion to the silicone emulsion supply tank.

4. The apparatus of claim 3 wherein the level fault signal activates a warning device to allert and operator that the first overflow level has been exceeded by the silicone emulsion in the applicator tray.

5. The apparatus of claim 1 wherein the pump is an electric pump submerged in the silicone emulsion in the supply tank.

6. The apparatus of claim 5 wherein the pump comprises a fluid line coupled to the applicator tray and an adjustable flow regulator to provide adjustably regulated flow of silicone emulsion to the applicator tray.

7. The apparatus of claim 6 further comprising mixing mean in the supply tank for continuously agitating the silicone emulsion.

8. The apparatus of claim 6 further comprising a zero level drain from draining all silicone emulsion from the applicator tray and returning the silicone emulsion to the supply tank.

9. The apparatus of claim 4 further comprising means for deactivating the pump in response to the level fault signal.

10. The apparatus of claim 9 further comprising means for inhibiting rotation of the rollers in response to the level fault signal.

11. Silicone application apparatus for applying controlled amounts of silicone emulsion to at least one surface of a moving web, comprising:

silicone emulsion holding means for holding a supply of silicone emulsion for application to the web surface;

silicone emulsion supply mean for supplying silicone emulsion to the holding means;

applicator means for transferring silicone emulsion from the holding mean to the surface of the web;

said holding mean comprising an operation level means for removing any excess silicone emulsion to maintain an operating silicone emulsion level;

electronic monitoring means for monitoring the silicone emulsion level and generating a level fault signal in response to the silicone emulsion in the holding means exceeding a firs overflow level which is a predetermined amount greater than the operating silicone emulsion level;

a backup overflow means for removing any excess silicone emulsion which exceeds a predetermined second overflow level of emulsion in the holding means, such level being greater than the first overflow level;

means in the silicone supply means for continuously agitating the silicone emulsion; and means for deactivating the applicator means to stop transfer of silicone emulsion from the holding means to the surface of the web in response to the level fault signal.

12. The apparatus of claim 11 wherein the level fault signal activates a warning means for alerting an operator that the first overflow level has been exceeded by the silicone emulsion in the holding means.

13. The apparatus of claim 12 further comprises means for deactivating the supply means in response to the level fault signal.

14. A silicone application method for applying controlled amounts of silicone emulsion to at least one surface of a moving web, comprising the steps of:

holding a reservoir of silicone emulsion for application to the web surface;

supplying silicone emulsion to the reservoir;

transferring silicone emulsion from the reservoir to the surface of the web;

removing any excess silicone emulsion from the reservoir to maintain an operating silicone emulsion level;

automatically monitoring the silicone emulsion level in the reservoir and generating a level fault signal in response to the silicone emulsion in the reservoir exceeding a first overflow level which is a predetermined amount greater than the operating silicone emulsion level;

automatically removing any excess silicone emulsion which exceeds a predetermined second overflow level of emulsion in the reservoir, such level being greater than the first overflow level; and automatically interrupting the transfer of silicone emulsion from the reservoir to the surface of the web in response to the level fault signal.

15. The method of claim 14 further comprising the step of automatically alerting an operator that the first overflow level has been exceeded by the silicone emulsion in the holding means in response to the level fault signal.

16. The method of claim 15 further comprising the step of automatically interrupting the supplying of silicone emulsion to the reservoir in response to the level fault signal.

* * * * *

UNITED STATES PATENT AND TRADEMARK OFFICE

CERTIFICATE OF CORRECTION

PATENT NO. : 5,075,128

DATED : December 24, 1991

INVENTOR(S) : Gnuechtel et al

It is certified that error appears in the above-identified patent and that said Letters Patent is hereby corrected as shown below:

Column 2, line 22, delete "a application", and insert --an application--.

Column 6, line 23, delete ", and" and insert the following new paragraph:

--a backup overflow drain which drains any excess silicone emulsion which exceeds a predetermined second overflow level of emulsion in the applicator tray, such level being greater than the first overflow level; and--

Column 6, line 36, delete "allert and", and insert --alert an--.

Column 6, line 65, delete "mean for", and insert --means for--.

Column 6, line 68, delete "mean to", and insert --means to--.

Column 7, line 1, delete "mean comprising", and insert --means comprising--.

UNITED STATES PATENT AND TRADEMARK OFFICE

CERTIFICATE OF CORRECTION

PATENT NO. : 5,075,128

DATED : December 24, 1991

INVENTOR(S) : Gnuechtel et al

It is certified that error appears in the above-identified patent and that said Letters Patent is hereby corrected as shown below:

Column 7, line 7, delete "a firs", and insert --a first--.

Signed and Sealed this

Thirteenth Day of April, 1993

*Attest:*

STEPHEN G. KUNIN

*Attesting Officer*

*Acting Commissioner of Patents and Trademarks*